US005809384A

United States Patent [19]

Johroku et al.

[11] Patent Number: 5,809,384

[45] Date of Patent: Sep. 15, 1998

[54] DEVELOPING DEVICE AND TONER CARTRIDGE APPLIED TO SAME

[75] Inventors: Kazuo Johroku; Masanobu Maeshima, both of Osaka, Japan

[73] Assignee: Mita Industrial Co., Ltd., Osaka, Japan

[21] Appl. No.: 742,683

[22] Filed: Oct. 31, 1996

[30] Foreign Application Priority Data

Nov. 10, 1995 [JP] Japan ..... 7-292551

[51] Int. Cl.[6] ..... G03G 15/08; G03G 21/12

[52] U.S. Cl. ..... 399/262; 399/120; 222/DIG. 1; 222/171

[58] Field of Search ..... 399/120, 119, 399/258, 262, 27; 222/DIG. 1, 167, 169, 171, 325

[56] References Cited

U.S. PATENT DOCUMENTS

| | | | |
|---|---|---|---|
| 5,078,303 | 1/1992 | Kikuchi et al. | 222/167 |
| 5,294,960 | 3/1994 | Nomura et al. . | |
| 5,331,378 | 7/1994 | Baker et al. . | |
| 5,479,247 | 12/1995 | Watanabe . | |
| 5,541,714 | 7/1996 | Watanabe . | |
| 5,614,996 | 3/1997 | Tanda | 399/120 |
| 5,617,198 | 4/1997 | Ishikawa et al. | 399/27 |

*Primary Examiner*—R. L. Moses
*Attorney, Agent, or Firm*—Beveridge, DeGrandi, Weilacher & Young, LLP

[57] ABSTRACT

A developing device includes a toner cartridge mounting portion, and a toner cartridge to be detachably mounted on the toner cartridge mounting portion. The toner cartridge mounting portion has a bottom wall having a toner acceptance opening formed therein, and a pair of supporting side walls disposed on the opposite side edges of the bottom wall, and an engaging means is disposed on the inner surface of one of the supporting side walls. The toner cartridge includes a generally cylindrical container having an unsealably sealed toner discharge opening formed in the peripheral wall of the container, and a toner accommodated in the container. An engaged means to be engaged with the engaging means is disposed in the outer surface of one side wall of the container. The one side wall of the container is opposed to the inner surface of the one of the supporting side walls to engage the engaging means and the engaged means with each other, and the other side wall of the container is opposed to the inner surface of the other of the pair of supporting side walls, whereby the toner cartridge is mounted on the toner cartridge mounting portion.

24 Claims, 5 Drawing Sheets

DEVELOPING DEVICE AND TONER CARTRIDGE APPLIED TO SAME

FIELD OF THE INVENTION

This invention relates to a developing device which is mounted on an image forming machine, such as an electrostatic copying apparatus, a printer, or a facsimile, to develop a latent electrostatic image to a toner image, and a toner cartridge applied to such a developing device.

DESCRIPTION OF THE PRIOR ART

As is well known, an image forming machine forms a latent electrostatic image on an electrostatic photoconductor, develops this image to a toner image, and transfers the toner image on the photoconductor onto a sheet member, optionally a plain paper. A developing device for developing a latent electrostatic image to a toner image applies a so-called one component developer comprising only a toner, or a so-called two component developer comprising a toner and carrier particles onto the electrostatic photoconductor to develop a latent electrostatic image to a toner image. With such a developing device, the toner is consumed as development takes place, and a fresh toner needs to be fed where necessary. Usually, therefore, a toner cartridge mounting portion is disposed in the developing device, and a toner cartridge is detachably mounted on the toner cartridge mounting portion. The toner cartridge includes a container, and a toner accommodated in this container. When the toner in the container of the toner cartridge mounted on the toner cartridge mounting portion is substantially absent, requiring the supply of a toner to the developing device, the toner cartridge mounted on the toner cartridge mounting portion is replaced by a new toner cartridge.

A toner cartridge of the type including a generally cylindrical container is in wide use. A typical example of such a toner cartridge includes, in addition to the generally cylindrical container, a cover member which similarly has a generally cylindrical shape. The container is concentrically and rotatably integrated into the cover member. A toner discharge opening is formed in the peripheral wall of the container, and a toner passage opening is formed in the cover member. Before the toner cartridge is mounted on the toner cartridge mounting portion of the developing device, the toner discharge opening of the container and the toner passage opening of the cover member are positioned so as to be displaced relative to each other in the peripheral direction, whereby the toner discharge opening is sealed.

A typical example of the toner cartridge mounting portion in the developing device, to which the above-described toner cartridge is applied, has a pair of upright walls disposed with a predetermined spacing, and an insertion opening is formed in one of the pair of upright walls. The toner cartridge is longitudinally moved through the insertion opening, whereby the toner cartridge is inserted between the pair of upright walls. Then, the container of the toner cartridge is rotated to bring the toner discharge opening formed in the peripheral wall of the container into alignment with the toner passage opening formed in the cover member. When the toner discharge opening is unsealed, the toner accommodated in the container is flowed from inside the container through the toner discharge opening and the toner passage opening. To release the toner cartridge from the toner cartridge mounting portion, the first step is to rotate the container, thereby displacing the toner discharge opening peripherally relative to the toner passage opening of the cover member to reseal the toner discharge opening. Then, the toner cartridge is withdrawn through the insertion opening.

However, a developing device of the above-described type poses the following problems: The toner cartridge mounting portion needs to be provided with guide means for appropriately guiding the toner cartridge longitudinally moved through the insertion opening. Such guide means needs to extend over nearly the entire length of the slender toner cartridge. Hence, the toner cartridge mounting portion becomes relatively complicated in structure and expensive in cost. Moreover, mounting and releasing operations for moving the toner cartridge in its longitudinal direction through the insertion opening are relatively tiresome.

SUMMARY OF THE INVENTION

An object of the present invention, therefore, is to provide a novel and improved developing device capable of mounting the toner cartridge on the toner cartridge mounting portion as required, by moving the toner cartridge nearly in its diametrical direction, without moving the toner cartridge in its longitudinal direction.

Another object of the invention is to provide a novel and improved developing device in which the structure of the toner cartridge mounting portion is relatively simple and inexpensive.

Still another object of the invention is to provide a novel and improved developing device in which operations for mounting and releasing the toner cartridge on and from the toner cartridge mounting portion are easy.

A further object of the invention is to provide a novel and improved developing device in which a toner recovery container for recovering a toner removed from an electrostatic photoconductor after transfer of a toner image from the electrostatic photoconductor onto a sheet member is mounted on the toner cartridge so that the toner recovery container may be mounted and released in accordance with the mounting and release of the toner cartridge, thus making it possible to simultaneously perform the replacement of the toner cartridge and the replacement of the toner recovery container.

It is also an object of the invention to provide a novel and improved toner cartridge itself which is applied to the above-described novel and improved developing device.

According to one aspect of the present invention, there is provided a developing device including a toner cartridge mounting portion and a toner cartridge to be detachably mounted on the toner cartridge mounting portion; wherein the toner cartridge mounting portion has a bottom wall having a toner acceptance opening formed therein, and a pair of supporting side walls disposed on the opposite side edges of the bottom wall, the inner surface of one of the supporting side walls having an engaging means disposed thereon;

the toner cartridge includes a generally cylindrical container having an unsealably sealed toner discharge opening formed in the peripheral wall of the container, and a toner accommodated in the container, the outer surface of one side wall of the container having an engaged means disposed therein for engagement with the engaging means; and the one side wall of the container is opposed to the inner surface of the one of the supporting side walls to engage the engaging means and the engaged means with each other, and the other side wall of the container is opposed to the inner surface of the other of the pair of supporting side walls, whereby the toner cartridge is mounted on the toner cartridge mounting portion, the longitudinal movement of the toner cartridge is restrained by the pair of supporting side walls, and the diametrical movement of the toner cartridge is restrained by the engagement of the engaging means and the engaged means.

According to another aspect of the present invention, there is provided a toner cartridge for use in a developing device including a toner cartridge mounting portion which has a bottom wall having a toner acceptance opening formed therein, and a pair of supporting side walls disposed on the opposite side edges of the bottom wall, the inner surface of one of the supporting side walls having an engaging means disposed thereon; wherein the toner cartridge includes a generally cylindrical container having an unsealably sealed toner discharge opening formed in the peripheral wall of the container, and a toner accommodated in the container, the outer surface of one side wall of the container having an engaged means formed therein for engagement with the engaging means; and the one side wall of the container is opposed to the inner surface of the one of the supporting side walls to engage the engaging means and the engaged means with each other, and the other side wall of the container is opposed to the inner surface of the other of the pair of supporting side walls, whereby the toner cartridge is mounted on the toner cartridge mounting portion, the longitudinal movement of the toner cartridge is restrained by the pair of supporting side walls, and the diametrical movement of the toner cartridge is restrained by the engagement of the engaging means and the engaged means.

Advantageously, the toner cartridge includes a cover member which is generally cylindrical in shape and which has a toner passage opening formed in its peripheral wall. The container is concentrically and rotatably integrated into the cover member. The toner discharge opening of the container and the toner passage opening of the cover member are positioned so as to be peripherally displaced relative to each other, thereby sealing the toner discharge opening. With the toner passage opening of the cover member being aligned with the toner acceptance opening of the toner cartridge mounting portion, the toner cartridge is mounted on the toner cartridge mounting portion. The container is rotated to bring the toner discharge opening of the container into alignment with the toner passage opening of the cover member to unseal the toner discharge opening. Thus, the toner is flowed through the toner discharge opening, the toner passage opening, and the toner acceptance opening.

Preferably, on the inner surface of the one of the supporting side walls of the toner cartridge mounting portion, there is disposed a rotary member so as to be rotatable between a first angular position and a second angular position about a central axis of rotation extending in the longitudinal direction of the toner cartridge mounting portion. The engaging means is formed on the inner surface of the rotary member. When the engaged means formed on the one side wall of the container of the toner cartridge is engaged with the engaging means through one opened side surface of the cover member of the toner cartridge, the relative rotations of the rotary member and the container are inhibited. When the rotary member is rotated from the first angular position to the second angular position, the container is rotated accordingly to align the toner discharge opening with the toner passage opening. When the rotary member is returned from the second angular position to the first angular position, the toner discharge opening is position so as to be peripherally displaced relative to the toner passage opening. A grip arm is formed on the rotary member. A visible mark is made on the peripheral surface of the rotary member, and a visible mark is made also on the engaged means of the container. When the angular position of the visible mark of the rotary member is aligned with the angular position of the visible mark of the engaged means, it becomes possible to engage the engaged means with the engaging means. On the other of the supporting side walls of the toner cartridge mounting portion, there are formed a journal hole and a guide groove extending from the journal hole to the outer edge. On the outer surface of the other side wall of the container of the toner cartridge, there is formed a journaled portion protruding longitudinally outwardly. In opposing the other side wall of the container of the toner cartridge to the inner surface of the other of the supporting side walls of the toner cartridge mounting portion, it is preferred that the journaled portion be introduced into the journal hole through the guide groove. When the rotary member is rotated from the first angular position to the second angular position to rotate the container in order to align the toner discharge opening with the toner passage opening, the journaled portion is also rotated. Thus, the journaled portion is confined in the journal hole, and kept from moving from the journal hole to the guide groove. Advantageously, the guide groove has a width smaller than the diameter of the journal hole, while the journaled portion has a thickness substantially equal to or smaller than the width of the guide groove and has a width larger than the width of the guide groove and substantially equal to or smaller than the diameter of the journal hole. In a preferred embodiment, the cover member of the toner cartridge has a side wall positioned between the other side wall of the container and the other of the supporting side walls of the toner cartridge mounting portion. On this side wall, a toner recovery container mounting portion is disposed. The toner cartridge includes a toner recovery container to be detachably mounted on the toner recovery container mounting portion. A main portion of the toner recovery container mounted on the toner recovery container mounting portion is positioned adjacent the outer surface of the other of the supporting side walls of the toner cartridge mounting portion, when the toner cartridge is mounted on the toner cartridge mounting portion.

DETAILED DESCRIPTION OF THE PREFERRED EMBODIMENTS

Preferred embodiments of a developing device constructed in accordance with the present invention will be described in detail with reference to the accompanying drawings.

Figure 1:
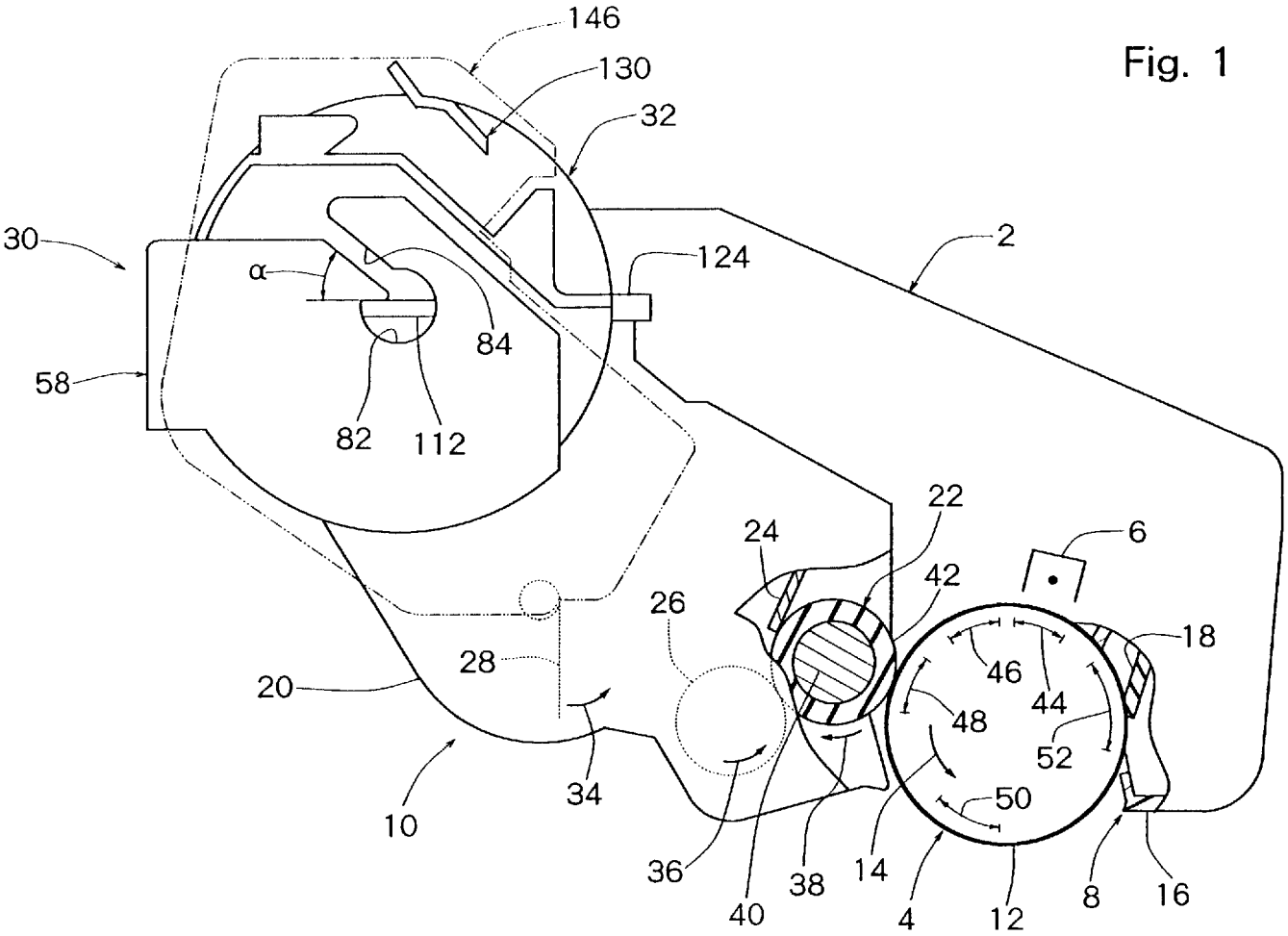
FIG. 1 is a simplified front view showing an imaging unit provided with a preferred embodiment of a developing device constructed in accordance with the present invention.

FIG. 1 shows an imaging unit equipped with a developing device constructed in accordance with the present invention. Such an imaging unit has a frame means generally designated by the numeral 2. The frame means 2 may be formed of a suitable plastic material. On the frame means, a developing device 10 constructed in accordance with the invention is mounted along with an image bearing means 4, a charging means 6 and a cleaning means 8. The image bearing means 4 is constructed of a rotating drum 12 having an electrostatic photoconductor disposed on the peripheral surface thereof. The rotating drum 12 is rotationally driven in the direction of an arrow 14. The charging means 6 is composed of a corona discharger for charging the peripheral surface of the rotating drum 12 to a specific polarity. The cleaning means 8 has a cleaning housing 16, in which a cleaning blade 18 is disposed. The cleaning blade 18 is formed of a flexible material such as synthetic rubber, and has its forward end portion pressed against the peripheral surface of the rotating drum 12.

The developing device 10 has a development housing 20, in which a developing roller 22, a developer regulating member 24, a developer replenishing roller 26 and a developer conveying member 28 are mounted. Furthermore, a toner cartridge mounting portion 30 is disposed at an upper end portion of the development housing 20. A toner cartridge 32 is detachably mounted on the toner cartridge mounting portion 30 (the toner cartridge mounting portion 30 and the toner cartridge 32 will be described in more detail later). A developer to be used in the developing device 10 may be a so-called one component developer consisting merely of a toner sent out of the toner cartridge 32. Such a developer is conveyed to the developer replenishing roller 26 by the action of the developer conveying member 28 rotationally driven in the direction of an arrow 34. The developer replenishing roller 26 rotationally driven in the direction of an arrow 36 feeds the developer onto the developing roller 22. The developer held on the developing roller 22 rotationally driven in the direction of an arrow 38 has its layer thickness regulated by the developer regulating member 24 to have a required value. The developing roller 22 is composed of a metallic shaft member 40, and a synthetic rubber roller member 42 disposed on the peripheral surface of the shaft member 40. The developing roller 22 is elastically pressed against the rotating drum 12.

The above-described imaging unit is detachably mounted at a required position of a machine body housing (not shown) of an image forming machine such as an electrostatic copying apparatus. The rotating drum 12 is rotationally driven in the direction of arrow 14. In a charging zone 44, the peripheral surface of the rotating drum 12 is uniformly charged to a specific polarity by the charging means 6. Then, in an exposure zone 46, the peripheral surface of the rotating drum 12 is irradiated with light, which corresponds to an image to be produced, by a suitable optical system (not shown). Thus, a latent electrostatic image is formed on the peripheral surface of the rotating drum 12. Then, the latent electrostatic image on the peripheral surface of the rotating drum 12 is developed to a toner image in a development zone 48 by the action of the developing roller 22 of the developing device 10. In a transfer zone 50, a transfer member (not shown), optionally a plain paper, is intimately contacted with the peripheral surface of the rotating drum 12, and the toner image formed on the peripheral surface of the rotating drum 12 is transferred onto the transfer member. The transfer member having the transferred toner image is peeled from the peripheral surface of the rotating drum 12, and conveyed to a fixing means (not shown). After the toner image is fixed by the action of the fixing means, the transfer member is expelled to the outside of the machine body housing. In a cleaning zone 52, residual toner remaining on the peripheral surface of the rotating drum 12 after transfer is removed from the peripheral surface of the rotating drum 12 by the action of the cleaning blade 18.

The foregoing construction and actions of the illustrated imaging unit (excluding the constructions and actions of the toner cartridge mounting portion 30 and the toner cartridge 32 mounted thereon in the developing device 10) do not constitute the improved and novel features of the present invention, but may be well known to those skilled in the art. Hence, explanations for their details will be omitted in the present specification.

Figure 2:
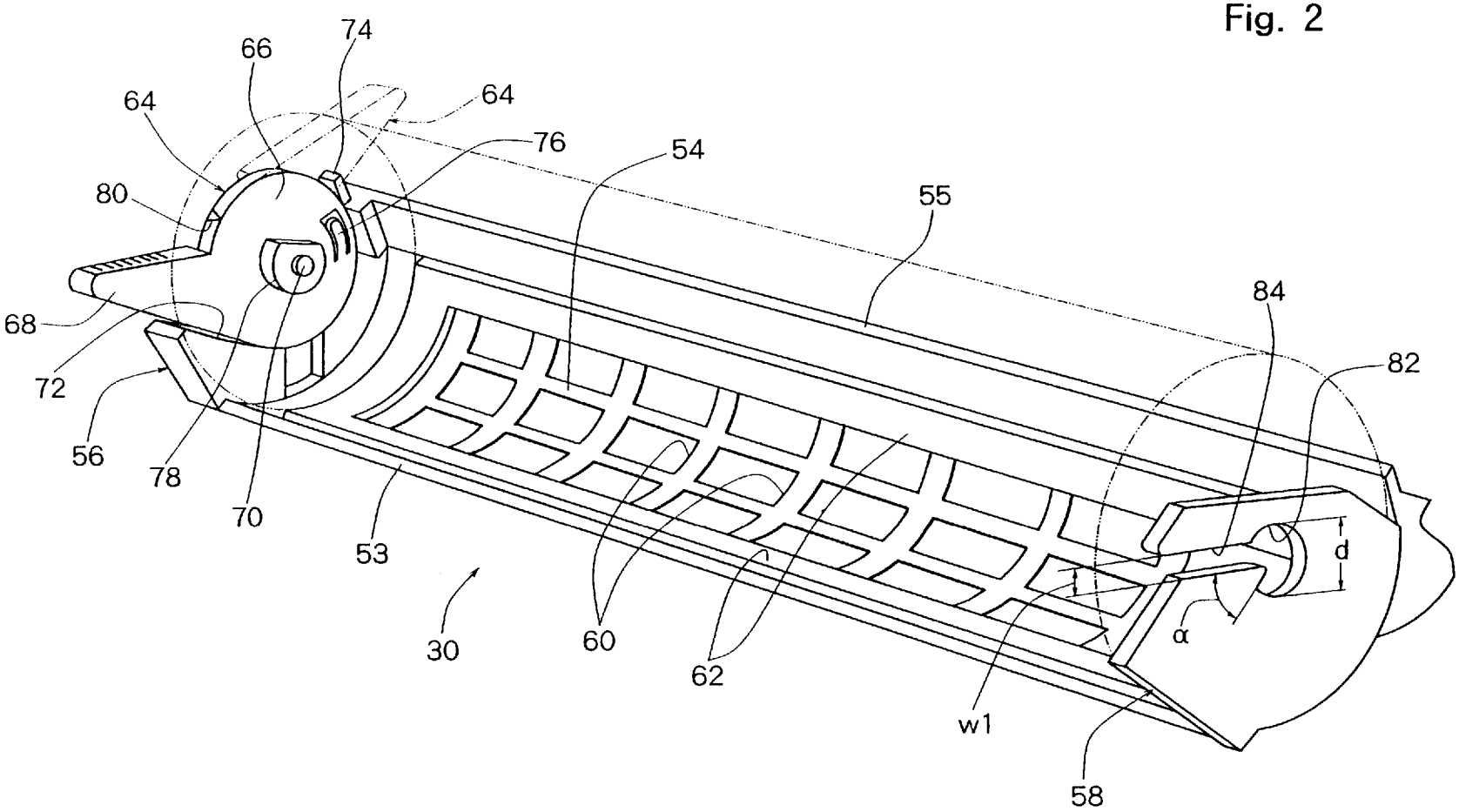
FIG. 2 is a perspective view showing a toner cartridge mounting portion in the developing device of FIG. 1.

Referring to FIG. 2 along with FIG. 1, the toner cartridge mounting portion 30 of the developing device 10 in the imaging unit includes a bottom wall 54 extending slenderly and substantially horizontally in the direction of the central axis of the rotating drum 12 (the direction perpendicular to the sheet face in FIG. 1), and a pair of supporting side walls 56 and 58 disposed at the opposite side edges of the bottom wall 54. The cross section of the bottom wall 54 is nearly semicircular. In the bottom wall 54 there are formed a plurality of toner acceptance openings 60 arranged suitably. A sealing member 62 extending around the toner acceptance opening 60 is bonded onto the bottom wall 54. The sealing member 62 may be made of a foamed plastic material. On the bottom wall 54, there are further formed a pair of shoulder surfaces 53 and 55 extending substantially horizontally in the longitudinal direction on the outside of the sealing member 62. The pair of supporting side walls 56 and 58 extend substantially vertically upwardly from the opposite side edges of the bottom wall 54.

Further with reference to FIG. 2, a rotary member 64 is mounted on the inner surface of the supporting side wall 56 of the toner cartridge mounting portion 30. The rotary member 64 has a disc-shaped main portion 66, and a grip arm 68 of a nearly triangular shape protruding from the main portion 66. A circular hole is formed in the center of the main portion 66, and a forward end portion of a mounting member 70 extending through this circular hole is screwed to the supporting side wall 56. Thus, the rotary member 64 is mounted so as to be rotatable between a first angular position shown by a solid line and a second angular position shown by a two-dot chain line. The mounting member 70 extends substantially horizontally in the longitudinal direction of the toner cartridge mounting portion 30 (the direction perpendicular to the sheet face in FIG. 1). Hence, the rotary member 64 is mounted so as to be rotatable about a central axis of rotation (the central axis of the mounting member 70) extending substantially horizontally in the longitudinal direction of the toner cartridge mounting portion 30. When the rotary member 64 is brought to the first angular position, one side surface of the grip arm 68 contacts a contact portion 72 formed in the supporting side wall 56, thereby inhibiting the rotary member 64 from rotating beyond the first angular position. Similarly, when the rotary member 64 is brought to the second angular position, the other side surface of the grip arm 68 contacts a contact portion 74 formed in the supporting side wall 56, thereby inhibiting the rotary member 64 from rotating beyond the second angular position. An elastic tongue piece 76 demarcated by a nearly channel-like groove is formed in the main portion 66 of the rotary member 64. A hemispherical protrusion (not shown) is formed on the outer surface of the elastic tongue piece 76. On the inner surface of the supporting side wall 56, two hemispherical depressions (not shown) are formed with a predetermined angular spacing. When the rotary member 64 is located at the aforesaid first angular position, the protrusion formed on the elastic tongue piece 76 elastically engages one of the two depressions formed on the supporting side wall 56, whereby the rotary member 64 is elastically held at the first angular position. When the rotary member 64 is located at the aforesaid second angular position, the protrusion formed on the elastic tongue piece 76 elastically engages the other of the two depressions formed on the supporting side wall 56, whereby the rotary member 64 is elastically held at the second angular position. Furthermore, a protrusion constituting an engaging means 78 is formed at the center of the inner surface of the main portion 66 of the rotary member 64. This protrusion may be in the shape of a partly cut off circle. On the outer peripheral surface of the main portion 66 of the rotary member 64, there is formed a visible mark 80 composed of a triangular projection.

With reference to FIG. 2, a journal hole 82 and a guide groove 84 extending from the journal hole 82 to the outer edge are formed in the other supporting side wall 58. The journal hole 82 is nearly circular, and the guide groove 84 extends straightly at an angle of inclination, $\alpha$, advantageously of from about 20 to 60 degrees to the horizontal. The width w1 of the guide groove 84 is advantageously smaller than the diameter d of the journal hole 82, say, about a third of the diameter d of the journal hole 82.

Figure 6:
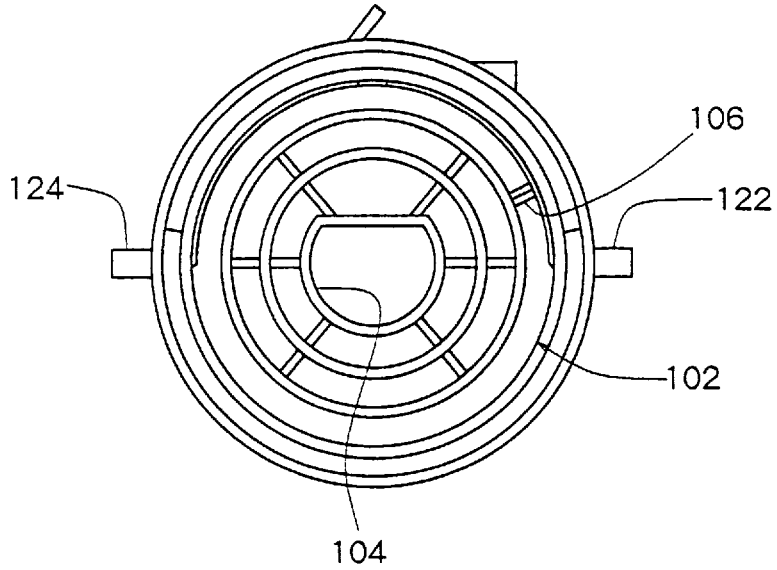
FIG. 6 is one side view of the toner cartridge in the developing device of FIG. 1.
Figure 7:
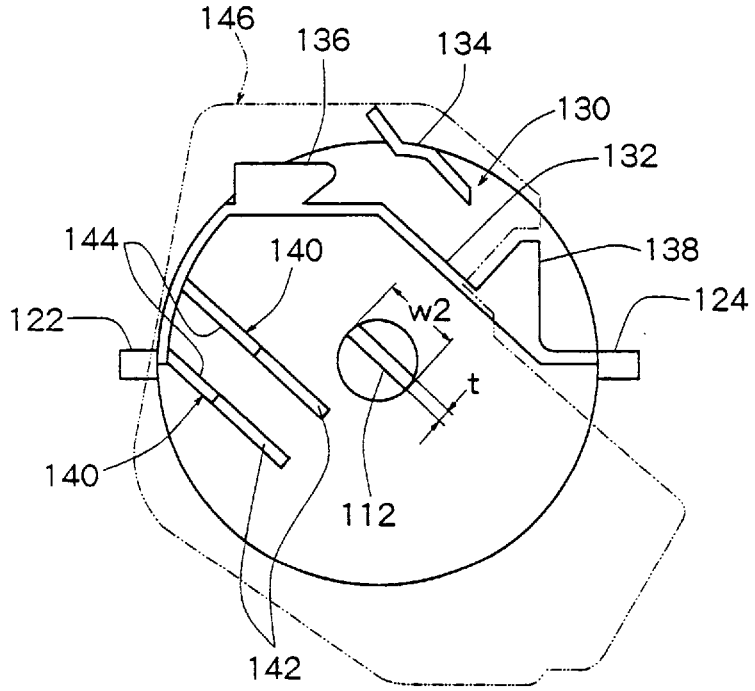
FIG. 7 is the other side view of the toner cartridge in the developing device of FIG. 1.

Next, the toner cartridge 32 will be described by reference to FIG. 3. The toner cartridge 32 in the illustrated embodiment includes a generally cylindrical container 86. The container 86 which may be molded from a suitable plastic material has a peripheral wall 88, and a toner discharge opening 90 is formed in a specific angular region of the peripheral wall 88. The toner discharge opening 90 may be in a longitudinally extending nearly rectangular shape. A plurality of ribs 92 extending across the toner discharge opening 90 are formed to reinforce the container 86. To the outer surface of the peripheral wall 88, a sealing member 94 extending around the toner discharge opening 90 is bonded. An end wall 96 is formed at one end portion of the container 86. A circular opening 98 is formed in this end wall 96. On the outer surface of the end wall 96, there are formed a plurality of ribs 99 extending radially outwardly from the peripheral edge of the opening 98. A closure member 100 is secured to the opening 98 by a suitable method, such as bonding or fusion bonding, after a toner is filled into the container 86 through the opening 98 as will be further described later, whereby the opening 98 is closed. The peripheral wall 88 extends longitudinally outwardly beyond the end wall 96. At one end of the container 86, a nearly disc-shaped additional member 102 is mounted further. With reference to FIG. 6 along with FIG. 3, a through-hole constituting an engaged means 104 is formed at the center of the additional member 102 which may be molded from a suitable plastic material. The cross sectional shape of the through-hole corresponds to the cross sectional shape of the protrusion constituting the aforementioned engaging means 78. As will be described later, in mounting the toner cartridge 32 on the toner cartridge mounting portion 30, the engaging means 78 is received into the engaged means 104, whereby they are engaged. On the outer peripheral surface of the additional member 102, a visible mark 106 is formed which may be a slender triangular projection. The additional member 102 is further provided with a plurality of arcuate protruding pieces 107 and connecting nib pieces 108 which protrude inwardly from the peripheral edge of the additional member 102. This additional member 102, as will be described later, is connected to the other end surface of the peripheral wall 88 by securing the closure member 100 to the end wall 96 of the container 86, then positioning the arcuate protruding pieces 107 between the ribs 99 formed on the end wall 96 of the container 86, and simultaneously elastically engaging the connecting nib pieces 108 with the inner surface of an extending end portion of the peripheral wall 88. Since the arcuate protruding pieces 107 of the additional member 102 are positioned between the ribs 99, the relative rotation of the additional member 102 with respect to the container 86 is reliably inhibited. The other end of the container 86 is closed by an end wall 110 integrally formed with the peripheral wall 88. On the outer surface of this end wall 110, a journaled portion 112 is integrally formed which protrudes longitudinally outwardly from the center of this outer surface. Referring to FIG. 7 along with FIG. 3, the cross sectional shape of a forward end portion of the journaled portion 112 is a shape corresponding to part of a circle, more specifically, a shape defined by the circumference of the circle, the diameter of the circle, and a chord extending parallel to this diameter. The width of the journaled portion 112 (the diameter of that circle), w2, is substantially equal to or slightly smaller than the diameter d of the journal hole 82, and larger than the width w1 of the guide groove 84. The thickness of the journaled portion 112, t, is substantially equal to or slightly smaller than the width w1 of the guide groove 84.

Figure 3:
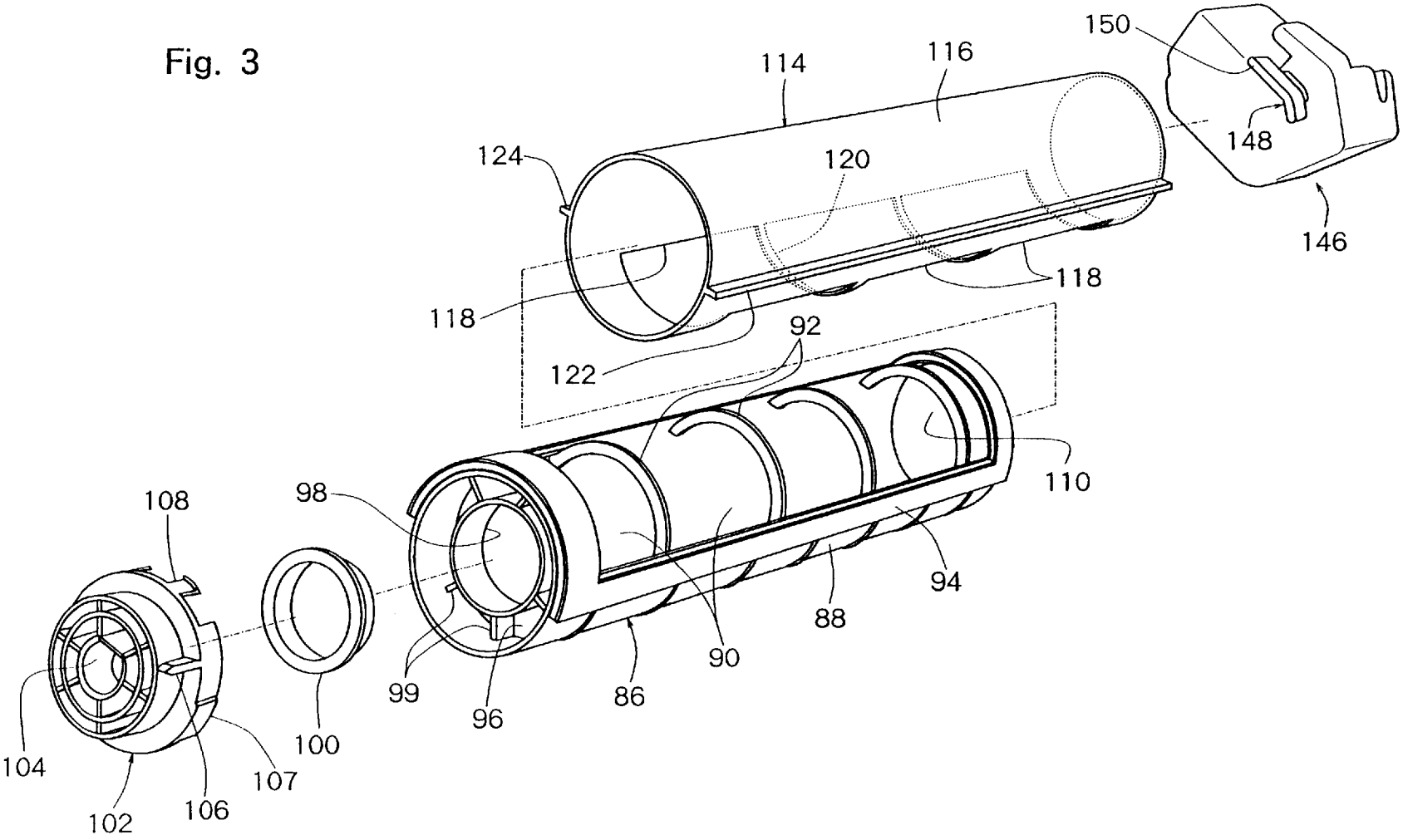
FIG. 3 is an exploded perspective view showing a toner cartridge in the developing device of FIG. 1.
Figure 4:
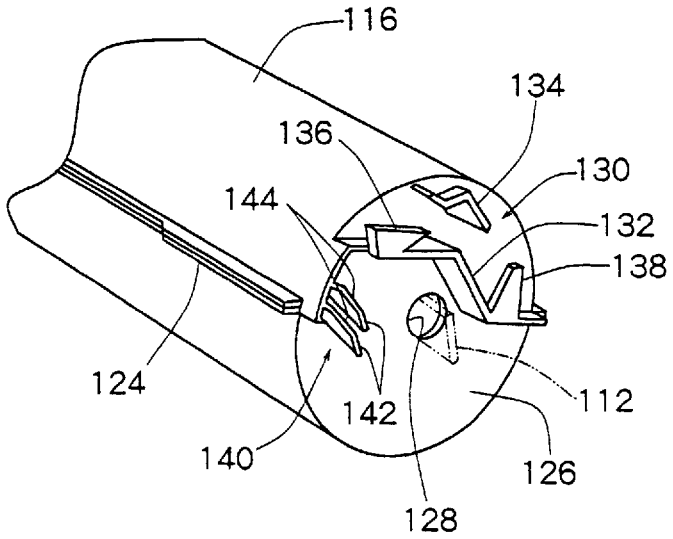
FIG. 4 is a perspective view showing a part of a cover member of the toner cartridge in the developing device of FIG. 1.

Further referring to FIG. 3, the toner cartridge 32 also includes a generally cylindrical cover member 114. The cover member 114 which may be molded from a suitable plastic material has a peripheral wall 116, and a toner passage opening 118 is formed in a specific angular region of the peripheral wall 116. The toner passage opening 118 may be in a longitudinally extending nearly rectangular shape. A plurality of ribs 120 extending across the toner passage opening 118 are formed to reinforce the cover member 114. On the outer surface of the peripheral wall 116, there are formed two contact pieces 122 and 124 with an angular spacing of nearly 180 degrees. Each of the contact pieces 122 and 124 protrudes substantially horizontally from the peripheral wall 116, and longitudinally extends over nearly the entire length of the peripheral wall 116. One end of the cover member 114 is wholly opened. By reference to FIG. 4, an end wall 126 integrally molded with the peripheral wall 116 is disposed at the other end of the cover member 114. At the center of the end wall 126, an opening 128, optionally circular, is formed. On the outer surface of the end wall 126, a toner recovery container mounting portion 130 is formed. The toner recovery container mounting portion 130 is composed of a lower regulating rail 132, and an upper regulating rail 134 disposed upwardly of the lower regulating rail 132 with a spacing. At outside edge portions of the lower regulating rail 132, two upright regulating pieces 136 and 138 are formed. On the outer surface of the end wall 126, a pair of guided pieces 140 extending parallel to each other are formed. Each of the guided pieces 140 has an inclined portion 142 extending longitudinally outwardly from the central portion toward the peripheral edge portion of the end surface 126, and a non-inclined portion 144 extending as a continuum from the inclined portion 142 and parallel to the end surface 126.

By reference to FIG. 3, in the illustrated embodiment, a toner recovery container 146 is combined with the toner cartridge 32 to be mounted on the toner cartridge mounting portion 30. At an upper end portion of one side surface of the toner recovery container 146, which may be molded from a suitable plastic material, a connecting portion 148 is integrally formed. This connecting portion 148 has a regulated rail 150. The shape of the regulated rail 150 corresponds to the shape of a space defined between the lower regulating rail 132 and the upper regulating rail 134 of the toner recovery container mounting portion 130 disposed on the cover member 114.

Figure 5:
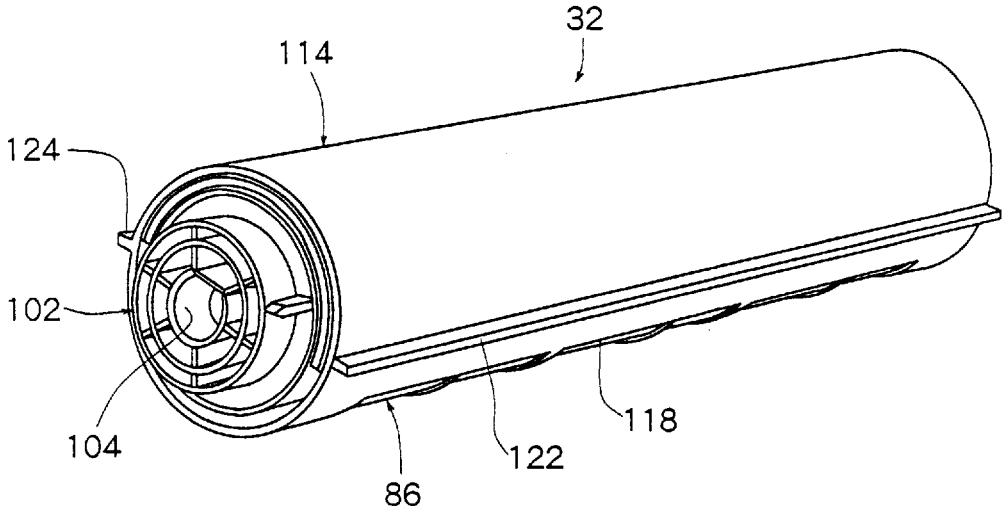
FIG. 5 is a perspective view showing the toner cartridge in the developing device of FIG. 1.

Referring to FIG. 5 along with FIG. 3, the toner cartridge 32 is subjected to assembly in the following manner: First, the container 86 is inserted into the cover member 114 through the one opened end of the cover member 114. On this occasion, the container 86 is brought to an angular position where its toner discharge opening 90 becomes open upwardly. The cover member 114, on the other hand, is brought to an angular position where its toner passage opening 118 becomes open downwardly. Hence, the toner discharge opening 90 and the toner passage opening 118 are positioned so as to be peripherally displaced relative to each other, so that the toner discharge opening 118 of the container 86 is closed by the peripheral wall 116 of the cover member 114. The sealing member 94 bonded to the peripheral wall 88 of the container 86 is intimately contacted with the inner surface of the peripheral wall 116 of the cover member 114, thereby fully sealing the toner discharge opening 90. As will be clearly understood by reference to FIG. 4, the journaled portion 112 formed on the end wall 110 of the container 86 protrudes through the opening 128 formed in the end wall 126 of the cover member 114. Then, a required amount of toner is filled into the container 86 through the one opened end surface of the cover member 114 and the opening 98 formed in the end wall 96 of the container 86. Thereafter, the closure member 100 is secured to the end wall 96 of the container 86 to close the opening 98, whereby the toner is sealed up in the container 86. Then, the additional member 102 is coupled to one end of the container 86. Further, the toner recovery container 146 is detachably mounted on the toner recovery container mounting portion 130 formed on the end wall 126 of the cover member 114. The mounting of the toner recovery container 146 is performed by inserting the regulated rail 150 of the connecting portion 148 of the toner recovery container 146 into the space between the lower regulating rail 132 and the upper regulating rail 134 of the toner recovery container mounting portion 130 of the cover member 114, with at least one of the lower regulating rail 132, the upper regulating rail 134 and the regulated rail 150 being somewhat deformed elastically.

Next, the mounting and releasing of the toner cartridge 32 on and from the toner cartridge mounting portion 30 will be described with reference to FIGS. 1 to 7, especially FIG. 2 and FIG. 5. In mounting the toner cartridge 32 on the toner cartridge mounting portion 30, the toner cartridge 32 is not moved longitudinally, but lowered in a direction normal to the longitudinal direction, and approached to the toner cartridge mounting portion 30. Then, the toner cartridge 32 is brought to a state in which it extends somewhat upwardly inclinedly from the one end, where the additional member 102 is disposed, toward the other end where the journaled portion 112 is disposed. In this state, the engaged means 104 (i.e. the through-hole) disposed in the additional member 102 is engaged with the engaging means 78 (i.e. the protrusion) disposed on the rotary member 64 of the toner cartridge mounting portion 30. When, at this time, the visible mark 80 formed on the rotary member 64 and the visible mark 106 formed on the additional member 102 are aligned, the angular position of the toner cartridge 32 relative to the rotary member 64 is appropriately set, whereby the engaged means 104 is appropriately positioned relative to the engaging means 78. Then, the other end of the toner cartridge 32 is moved to introduce the journaled portion 112 formed on the container 86 into the journal hole 82 through the guide groove 84. On this occasion, the journaled portion 112 has its width direction conformed to the extending direction of the guide groove 84. During the movement of the journaled portion 112 through the guide groove 84, the forward edges of the guided pieces 140 formed on the end wall 126 of the cover member 114 are contacted with the inner surface of the supporting side wall 58. Thus, owing to the presence of the inclined portions 142 of the forward edges of the guided pieces 140, the toner cartridge 32 is guided toward the supporting side wall 56, whereby the longitudinal position of the toner cartridge 32 relative to the toner cartridge mounting portion 30 is regulated. When the toner cartridge 32 is mounted on the toner cartridge mounting portion 30, the pair of contact pieces 122 and 124 formed on the cover member 114 of the toner cartridge 32 are abutted against the pair of shoulder surfaces 53 and 55 disposed in the toner cartridge mounting portion 30. Also, the sealing member 62 disposed in the toner cartridge mounting portion 30 is intimately contacted with the outer surface of the peripheral wall 116 of the cover member 114 at the peripheral edge portion of the toner passage opening 118. Then, the grip arm 68 is gripped with fingers to rotate the rotary member 64 from the first angular position shown by the solid line in FIG. 2 to the second angular position shown by the two-dot chain line in FIG. 2. Since the engaging means 78 disposed on the rotary member 74 has engaged the engaged means 104 disposed in the additional member 102 coupled to the container 86, the container 86 is also rotated clockwise through a required angle in FIG. 1 in accordance with that rotation of the rotary member 64. Since the cover member 114 of the toner cartridge 32 has its pair of contact pieces 122 and 124 abutting against the pair of shoulder surfaces 53 and 55 of the toner cartridge mounting portion 30, the cover member 114 is prevented from rotating together with the container 86. When the container 86 is rotated through a required angle with respect to the cover member 114, the toner discharge opening 90 formed in the container 86 is aligned with the toner passage opening 118 of the cover member 114. Thus, the toner discharge opening 90 is unsealed, whereupon the toner inside the container 86 is flowed through the toner discharge opening 90, the toner passage opening 118 and the toner acceptance opening 60, and fed into the development housing 20. Furthermore, when the container 86 is rotated clockwise through a required angle in FIG. 1, as will be clearly understood by comparison between FIGS. 7 and 1, the journaled portion 112 is rotated in the journal hole 82 through a required angle, so that the width direction of the journaled portion 112 becomes nearly normal to the guide groove 84. Hence, it becomes impossible to release the journaled portion 112 from the journal hole 82, with the result that the journaled portion 112 is confined in the journal hole 82.

When the toner cartridge 32 is mounted on the toner cartridge mounting portion 30 in the above-described manner, the end wall 126 of the cover member 114 is positioned inwardly of the supporting side wall 58 (more specifically, between the end wall 110 of the container 86 and the supporting side wall 58), while the toner recovery container 146 (shown by the two-dot chain line in FIGS. 1 and 7) mounted on the toner recovery container mounting portion 130 disposed on the end wall 126 is positioned outwardly of the supporting side wall 58. A toner introduction opening (not shown) is formed in the toner recovery container 146, and the outlet opening of a toner carriage pipe (not shown) is made to communicate with this introduction opening. The toner removed from the peripheral surface of the rotating drum 12 by the action of the cleaning blade 18 of the cleaning means 8 is conveyed to the toner carriage pipe by a suitable conveying means, and introduced into the toner recovery container 146 through the toner carriage pipe. The relationship between the toner carriage pipe and the toner recovery container 146 is disclosed in U.S. patent application Ser. No. 08/680,012 (European Patent Application No. 96 122 168.8) of S. Taniguchi et al. Disclosures made therein will be cited in the present specification, and an explanation for that relationship will be omitted herein.

In releasing the toner cartridge 32, in which the toner in the container 86 has been used up, from the toner cartridge mounting portion 30, the first step is to grip the grip arm 68 with fingers, and rotate the rotary member 64 from the second angular position shown by the two-dot chain line in FIG. 2 to the first angular position shown by the solid line in FIG. 2. As a result, the container 86 is rotated counterclockwise through a required angle in FIG. 1 to be returned to its initial angular position (the angular position prior to the mounting of the toner cartridge 32 on the toner cartridge mounting portion 30). Thus, the toner discharge opening 90 of the container 86 is displaced in the peripheral direction from the toner passage opening 118 of the cover member 114 to reseal the toner discharge opening 90. Since the container 86 is rotated counterclockwise through a required angle in FIG. 1, the widthwise direction of the journaled portion 112 is brought into agreement with the extending direction of the guide groove 84. Thus, the journaled portion 112 becomes releasable from the journal hole 82 through the guide groove 84. Then, the journaled portion 112 is released from the journal hole 82, whereafter the engaged means 104 is released from the engaging means 78 to release the whole of the toner cartridge 32 from the toner cartridge mounting portion 30.

While some preferred embodiments of the present invention have been described in detail with reference to the accompanying drawings, it is to be understood that the invention is in no way limited thereto, but various changes and modifications may be made without departing from the spirit and scope of the invention.

What we claim is:

1. A developing device including a toner cartridge mounting portion and a toner cartridge to be detachably mounted on said toner cartridge mounting portion; wherein said toner cartridge mounting portion has a bottom wall having a toner acceptance opening formed therein, and a pair of supporting side walls disposed on the opposite side edges of said bottom wall, the inner surface of one of said supporting side walls having engaging means disposed thereon and the other of said supporting side walls having a journal hole passing therethrough and a guide groove extending from said journal hole to an outer edge of said other of said supporting side walls;

said toner cartridge includes a generally cylindrical container having an unsealably sealed toner discharge opening formed in the peripheral wall of said container, and a toner accommodated in said container, the outer surface of one side wall of said container having engaged means disposed therein for engagement with said engaging means, the outer surface of said other side wall having a journaled portion protruding longitudinally outwardly;

said one side wall of said container is opposed to the inner surface of said one of said supporting side walls to engage said engaging means and said engaged means with each other, and the other side wall of said container is opposed to the inner surface of the other of said pair of supporting side walls, whereby said toner cartridge is mounted on said toner cartridge mounting portion, the longitudinal movement of said toner cartridge is restrained by said pair of supporting side walls, and the diametrical movement of said toner cartridge is restrained by the engagement of said engaging means and said enlarged means; and said other side wall of said container of said toner cartridge is opposed to the inner surface of said other of said supporting side walls of said toner cartridge mounting portion, and said journaled portion is introduced into said journal hole through said guide groove.

2. The developing device of claim 1, wherein said toner cartridge includes a generally cylindrical cover member having a toner passage opening formed in the peripheral wall of said cover member, said container is concentrically and rotatably integrated into said cover member, and said toner discharge opening of said container and said toner passage opening of said cover member are positioned so as to be peripherally displaced relative to each other, thereby sealing said toner discharge opening; and with said toner passage opening of said cover member being aligned with said toner acceptance opening of said toner cartridge mounting portion, said toner cartridge is mounted on said toner cartridge mounting portion, and said container is rotated to bring said toner discharge opening of said container into alignment with said toner passage opening of said cover member to unseal said toner discharge opening, whereupon the toner is flowed through said toner discharge opening, said toner passage opening, and said toner acceptance opening.

3. The developing device of claim 2, wherein on the inner surface of said one of said supporting side walls of said toner cartridge mounting portion, there is disposed a rotary member so as to be rotatable between a first angular position and a second angular position about a central axis of rotation extending in the longitudinal direction of said toner cartridge mounting portion, and said engaging means is formed on the inner surface of said rotary member;

when said engaged means formed on said one side wall of said container of said toner cartridge is engaged with said engaging means through one opened side surface of said cover member of said toner cartridge, the relative rotations of said rotary member and said container are inhibited; when said rotary member is rotated from said first angular position to said second angular position, said container is rotated accordingly to align said toner discharge opening with said toner passage opening; and when said rotary member is returned from said second angular position to said first angular position, said toner discharge opening is position so as to be peripherally displaced relative to said toner passage opening.

4. The developing device of claim 3, wherein a grip arm is formed on said rotary member.

5. The developing device of claim 3, wherein a visible mark is made on the peripheral surface of said rotary member, and a visible mark is made also on said engaged means of said container, and when the angular position of said visible mark of said engaged means is aligned with the angular position of said visible mark of said rotary member, it becomes possible to engage said engaged means with said engaging means.

6. The developing device of claim 1, wherein when said rotary member is rotated from said first angular position to said second angular position to rotate said container in order to align said toner discharge opening with said toner passage opening, said journaled portion is also rotated, whereby said journaled portion is confined in said journal hole, and kept from moving from said journal hole to said guide groove.

7. The developing device of claim 6, wherein said guide groove has a width smaller than the diameter of said journal hole, while said journaled portion has a thickness substantially equal to or smaller than the width of said guide groove and has a width larger than the width of said guide groove and substantially equal to or smaller than the diameter of said journal hole.

8. A developing device including a toner cartridge mounting portion and a toner cartridge to be detachably mounted on said toner cartridge mounting portion; wherein said toner cartridge mounting portion has a bottom wall having a toner acceptance opening formed therein, and a pair of supporting side walls disposed on the opposite side edges of said bottom wall, the inner surface of one of said supporting side walls having engaging means disposed thereon;

said toner cartridge includes a generally cylindrical container having an unsealably sealed toner discharge opening formed in the peripheral wall of said container and a toner accommodated in said container, a generally cylindrical cover member having a toner passage opening formed in the peripheral wall of said cover member, said container is concentrically and rotatable integrated into said cover member, and said toner discharge opening of said container and said toner passage opening of said cover member are positioned so as to be peripherally displaced relative to each other, thereby sealing said toner discharge opening, said cover member of said toner cartridge has a side wall to be positioned between said other side wall of said container and said other of said supporting side walls of said toner cartridge mounting portion, and a toner recovery container mounting portion is disposed on said side wall, and a toner recovery container to be detachably mounted on said toner recovery container mounting portion, the outer surface of one side wall of said container having engaged means disposed therein for engagement with said engaging means;

said one side wall of said container is opposed to the inner surface of said one of said supporting side walls to engage said engaging means and said engaged means with each other, and the other side wall of said container is opposed to the inner surface of the other of said pair of supporting side walls, whereby said toner cartridge is mounted on said toner cartridge mounting portion, the longitudinal movement of said toner cartridge is restrained by said pair of supporting side walls, and the diametrical movement of said toner cartridge is restrained by the engagement of said engaging means and said enlarged means; and said toner passage opening of said cover member being aligned with said toner acceptance opening of said toner cartridge mounting portion, said toner cartridge is mounted on said toner cartridge mounting portion, and said container is rotated to bring said toner discharge opening of said container into alignment with said toner passage opening of said cover member to unseal said toner discharge opening, whereupon the toner flows through said toner discharge opening, said toner passage opening, and said toner acceptance opening.

9. The developing device of claim 8, wherein a main portion of said toner recovery container mounted on said toner recovery container mounting portion is positioned adjacent the outer surface of said other of said supporting side walls of said toner cartridge mounting portion, when said toner cartridge is mounted on said toner cartridge mounting portion.

10. A toner cartridge for use in a developing device including a toner cartridge mounting portion which has a bottom wall having a toner acceptance opening formed therein, and a pair of supporting side walls disposed on the opposite side edges of said bottom wall, the inner surface of one of said supporting side walls having engaging means disposed thereon and the other of said supporting side walls having a journal hole passing therethrough and a guide groove extending from said journal hole to the outer edge of said other of said supporting side walls; wherein said toner cartridge includes a generally cylindrical container having an unsealably sealed toner discharge opening formed in the peripheral wall of said container, and a toner accommodated in said container, the outer surface of one side wall of said container having engaged means formed therein for engagement with said engaging means, the outer surface of said other side wall of said container having a journaled portion protruding longitudinally outwardly;

said one side wall of said container is opposed to the inner surface of said one of said supporting side walls to engage said engaging means and said engaged means with each other, and the other side wall of said container is opposed to the inner surface of the other of said pair of supporting side walls, whereby said toner cartridge is mounted on said toner cartridge mounting portion, the longitudinal movement of said toner cartridge is restrained by said pair of supporting side walls, and the diametrical movement of said toner cartridge is restrained by the engagement of said engaging means and said engaged means; and said other side wall of said container is opposed to the inner surface of said other of said supporting side walls mounting portion, and said journaled portion is introduced into said journal hole through said guide groove.

11. The toner cartridge of claim 10, wherein said toner cartridge includes a generally cylindrical cover member having a toner passage opening formed in the peripheral wall of said cover member, said container is concentrically and rotatably integrated into said cover member, and said toner discharge opening if said container and said toner passage opening of said cover member are positioned so as to be peripherally displaced relative to each other, thereby sealing said toner discharge opening; and with said toner passage opening of said cover member being aligned with said toner acceptance opening of said toner cartridge mounting portion, said toner cartridge is mounted on said toner cartridge mounting portion, and said container is rotated to bring said toner discharge opening of said container into alignment with said toner passage opening of said cover member to unseal said toner discharge opening, whereupon the toner is flowed through said toner discharge opening, said toner passage opening, and said toner acceptance opening.

12. The toner cartridge of claim 11, wherein on the inner surface of said one of said supporting side walls of said toner cartridge mounting portion, there is disposed a rotary member so as to be rotatable between a first angular position and a second angular position about a central axis of rotation extending in the longitudinal direction of said toner cartridge mounting portion, and said engaging means is formed on the inner surface of said rotary member;

when said engaged means formed on said one side wall of said container is engaged with said engaging means through one opened side surface of said cover member, the relative rotations of said rotary member and said container are inhibited; when said rotary member is rotated from said first angular position to said second angular position, said container is rotated accordingly to align said toner discharge opening with said toner passage opening; and when said rotary member is returned from said second angular position to said first angular position, said toner discharge opening is position so as to be peripherally displaced relative to said toner passage opening.

13. The toner cartridge of claim 12, wherein a grip arm is formed on said rotary member.

14. The toner cartridge of claim 12, wherein a visible mark is made on the peripheral surface of said rotary member, and a visible mark is made also on said engaged means of said container, and when the angular position of said visible mark of said engaged means is aligned with the angular position of said visible mark of said rotary member, it becomes possible to engage said engaged means with said engaging means.

15. The toner cartridge of claim 10, wherein when said rotary member is rotated from said first angular position to said second angular position to rotate said container in order to align said toner discharge opening with said toner passage opening, said journaled portion is also rotated, whereby said journaled portion is confined in said journal hole, and kept from moving from said journal hole to said guide groove.

16. The toner cartridge of claim 15, wherein said guide groove has a width smaller than the diameter of said journal hole, while said journaled portion has a thickness substantially equal to or smaller than the width of said guide groove and has a width larger than the width of said guide groove and substantially equal to or smaller than the diameter of said journal hole.

17. A toner cartridge for use in a developing device including a toner cartridge mounting portion which has a bottom wall having a toner acceptance opening formed therein, and a pair of supporting side walls disposed on the opposite side edges of said bottom wall, the inner surface of one of said supporting side walls having engaging means disposed thereon; wherein said toner cartridge includes a generally cylindrical container having an unsealably sealed toner discharge opening formed in the peripheral wall of said container and a toner accommodated in said container, and a generally cylindrical cover member having a toner passage opening formed in the peripheral wall of said cover member, said container is concentrically and rotatable integrated into said cover member, and said toner discharge opening of said container and said toner passage opening of said cover member are positioned so as to be peripherally displaced relative to each other, thereby sealing said toner discharge opening, said cover member has a side wall to be positioned between said other side wall of said container and said other of said supporting side walls of said toner cartridge mounting portion, and a toner recovery container mounting portion is disposed on said side wall, and a toner recovery container to be detachably mounted on said toner recovery container mounting portion, the outer surface of one side wall of said container having engaged means formed therein for engagement with said engaging means;

said one side wall of said container is opposed to the inner surface of said one of said supporting side walls to engage said engaging means and said engaged means with each other, and the other side wall of said container is opposed to the inner surface of the other of said pair of supporting side walls, whereby said toner cartridge is mounted on said toner cartridge mounting portion, the longitudinal movement of said toner cartridge is restrained by said pair of supporting side walls, and the diametrical movement of said toner cartridge is restrained by the engagement of said engaging means and said engaged means; and said toner passage opening of said cover member being aligned with said toner acceptance opening of said toner cartridge mounting portion, said toner cartridge is mounted on said toner cartridge mounting portion, and said container is rotated to bring said toner discharge opening of said container into alignment with said toner passage opening of said cover member to unseal said toner discharge opening, whereupon the toner flows through said toner discharge opening, said toner passage opening, and said toner acceptance opening.

18. The toner cartridge of claim 17, wherein a main portion of said toner recovery container mounted on said toner recovery container mounting portion is positioned adjacent the outer surface of said other of said supporting side walls of said toner cartridge mounting portion, when said toner cartridge is mounted on said toner cartridge mounting portion.

19. A developing device including a toner cartridge mounting portion and a toner cartridge to be detachably mounted on said toner cartridge mounting portion; wherein said toner cartridge mounting portion has a bottom wall having a toner acceptance opening formed therein, and a pair of supporting side walls disposed on the opposite side edges of said bottom wall, the inner surface of one of said supporting side walls having engaging means disposed thereon and a rotary member disposed so as to be rotatable between a first angular position and a second angular position about a central axis of rotation extending in the longitudinal direction of said toner cartridge mounting portion, and said engaging means is formed on the inner surface of said rotary member, the other of said supporting side walls having a journal hole passing therethrough and a guide groove extending from said journal hole to an outer edge of said other of said supporting side walls, said guide groove has a width smaller than the diameter of said journal hole;

said toner cartridge includes a generally cylindrical container having an unsealably sealed toner discharge opening formed in the peripheral wall of said container and a toner accommodated in said container, a generally cylindrical cover member having a toner passage opening formed in the peripheral wall of said cover member, said container is concentrically and rotatably integrated into said cover member, and said toner discharge opening of said container and said toner passage opening of said cover member are positioned so as to be peripherally displaced relative to each other, thereby sealing said toner discharge opening, the outer surface of one side wall of said container having engaged means disposed therein for engagement with said engaging means, the outer surface of said other side wall of said container having a journaled portion protruding longitudinally outwardly, said journaled portion has a thickness substantially equal to or smaller than the width of said guide groove and has a width larger than the width of said guide groove and substantially equal to or smaller than the diameter of said journal hole;

said one side wall of said container is opposed to the inner surface of said one of said supporting side walls to engage said engaging means and said engaged means with each other, and the other side wall of said container is opposed to the inner surface of the other of said pair of supporting side walls, whereby said toner cartridge is mounted on said toner cartridge mounting portion, the longitudinal movement of said toner cartridge is restrained by said pair of supporting side walls, and the diametrical movement of said toner cartridge is restrained by the engagement of said engaging means and said enlarged means;

when said engaged means formed on said one side wall of said container of said toner cartridge is engaged with said engaging means through one opened side surface of said cover member of said toner cartridge, the relative rotations of said rotary member and said container are inhibited; when said rotary member is rotated from said first angular position to said second angular position, said container is rotated accordingly to align said toner discharge opening with said toner passage opening; and when said rotary member is returned from said second angular position to said first angular position, said toner discharge opening is positioned so as to be peripherally displaced relative to said toner passage opening;

said toner passage opening of said cover member being aligned with said toner acceptance opening of said toner cartridge mounting portion, said toner cartridge is mounted on said toner cartridge mounting portion, and said container is rotated to bring said toner discharge opening of said container into alignment with said toner passage opening of said cover member to unseal said toner discharge opening, whereupon the toner flows through said toner discharge opening, said toner passage opening, and said toner acceptance opening;

said other side wall of said container of said toner cartridge is opposed to the inner surface of said other of said supporting side walls of said toner cartridge mounting portion, said journaled portion is introduced into said journal hole through said guide groove;

when said rotary member is rotated from said first angular position to said second angular position to rotate said container in order to align said toner discharge opening with said toner passage opening, said journaled portion is also rotated, whereby said journaled portion is confined in said journal hole, and kept from moving from said journal hole to said guide groove.

20. The developing device of claim 19, wherein a grip arm is formed on said rotary member.

21. The developing device of claim 19, wherein a visible mark is made on the peripheral surface of said rotary member, and a visible mark is made also on said engaged means of said container, and when the angular position of said visible mark of said engaged means is aligned with the angular position of said visible mark of said rotary member, it becomes possible to engage said engaged means with said engaging means.

22. A toner cartridge for use in a developing device including a toner cartridge mounting portion which has a bottom wall having a toner acceptance opening formed therein, and a pair of supporting side walls disposed on the opposite side edges of said bottom wall, the inner surface of one of said supporting side walls having engaging means disposed thereon, and a rotary member disposed so as to be rotatable between a first angular position and a second angular position about a central axis of rotation extending in the longitudinal direction of said toner cartridge mounting portion, and said engaging means is formed on the inner surface of said rotary member, the other of said supporting side walls of said toner cartridge mounting portion having a journal hole passing therethrough and a guide groove extending from said journal hole to the outer edge of said other of said supporting side walls, said guide groove has a width smaller than the diameter of said journal hole; wherein said toner cartridge includes a generally cylindrical container having an unsealably sealed toner discharge opening formed in the peripheral wall of said container and a toner accommodated in said container, and a generally cylindrical cover member having a toner passage opening formed in the peripheral wall of said cover member, said container is concentrically and rotatably integrated into said cover member, and said toner discharge opening of said container and said toner passage opening of said cover member are positioned so as to be peripherally displaced relative to each other, thereby sealing said toner discharge opening, the outer surface of one side wall of said container having engaged means formed therein for engagement with said engaging means, the outer surface of said other side wall of said container having a journaled portion protruding longitudinally outwardly, said journaled portion has a thickness substantially equal to or smaller than the width of said guide groove and has a width larger than the width of said guide groove and substantially equal to or smaller than the diameter of said journal hole; and said one side wall of said container is opposed to the inner surface of said one of said supporting side walls to engage said engaging means and said engaged means with each other, and the other side wall of said container is opposed to the inner surface of the other of said pair of supporting side walls, whereby said toner cartridge is mounted on said toner cartridge mounting portion, the longitudinal movement of said toner cartridge is restrained by said pair of supporting side walls, and the diametrical movement of said toner cartridge is restrained by the engagement of said engaging means and said engaged means;

when said engaged means formed on said one side wall of said container is engaged with said engaging means through one opened side surface of said cover member the relative rotations of said rotary member and said container are inhibited; when said rotary member is rotated from said first angular position to said second angular position, said container is rotated accordingly to align said toner discharge opening with said toner passage opening; and when said rotary member is returned from said second angular position to said first angular position, said toner discharge opening is positioned so as to be peripherally displaced relative to said toner passage opening;

said toner passage opening of said cover member being aligned with said toner acceptance opening of said toner cartridge mounting portion, said toner cartridge is mounted on said toner cartridge mounting portion, and said container is rotated to bring said toner discharge opening of said container into alignment with said toner passage opening of said cover member to unseal said toner discharge opening, whereupon the toner flows through said toner discharge opening, said toner passage opening, and said toner acceptance opening;

said other side wall of said container is opposed to the inner surface of said other supporting side walls of said toner cartridge mounting portion, said journaled portion is introduced into said journal hole through said guide groove;

when said rotary member is rotated from said first angular position to said second angular position to rotate said container in order to align said toner discharge opening with said toner passage opening, said journaled portion is also rotated, whereby said journaled portion is confined in said journal hole, and kept from moving from said journal hole to said guide groove.

23. The toner cartridge of claim 22, wherein a grip arm is formed on said rotary member.

24. The toner cartridge of claim 22, wherein a visible mark is made on the peripheral surface of said rotary member, and a visible mark is made also on said engaged means of said container, and when the angular position of said visible mark of said engaged means is aligned with the angular position of said visible mark of said rotary member, it becomes possible to engage said engaged means with said engaging means.

* * * * *